United States Patent [19]

Pinkerton et al.

[11] Patent Number: 4,723,823

[45] Date of Patent: Feb. 9, 1988

[54] NIGHT LIGHT

[76] Inventors: Michael B. Pinkerton, 2015 144th SE., Bellevue, Wash. 98007; David Moskowitz, 1803 127th SE., Bellevue, Wash. 98005

[21] Appl. No.: 899,894

[22] Filed: Aug. 25, 1986

Related U.S. Application Data

[63] Continuation-in-part of Ser. No. 815,528, Jan. 2, 1986.

[51] Int. Cl.[4] ..... H01R 13/44

[52] U.S. Cl. ..... 439/136; 439/320

[58] Field of Search ..... 339/36, 39, 89 R, 75 P; 362/437, 226, 95; 220/241

[56] References Cited

U.S. PATENT DOCUMENTS

| | | | |
|---|---|---|---|
| 2,042,199 | 5/1936 | Thomas | 362/226 |
| 2,749,428 | 6/1956 | McCarthy | 362/95 |
| 3,363,216 | 1/1968 | Benedetto | 439/147 |
| 3,601,757 | 8/1971 | Gober | 439/147 |
| 3,656,083 | 4/1972 | Brook | 439/147 |
| 3,955,870 | 5/1976 | Wasserman | 439/144 |
| 4,076,360 | 2/1978 | Singh | 439/147 |
| 4,531,800 | 7/1985 | Avener | 439/373 |
| 4,561,045 | 12/1985 | Nishi et al. | 362/95 |

*Primary Examiner*—Gil Weidenfeld
*Assistant Examiner*—Paula A. Austin
*Attorney, Agent, or Firm*—Hughes & Cassidy

[57] ABSTRACT

Devices for protecting the bulb of a night light against damage and for denying access to the sockets of an electrical outlet into which the night light is plugged and for also denying access to those parts of the night light which might produce an electrical shock if touched. One component of the protective arrangement is a cover with externally threaded bosses which are apertured so that the night light can be plugged into a socket which a boss overlies by installing the night light through the aperture. The night light includes a bulb surrounding protective shield which is clamped against the boss by a safety cap of the push-and-twist type, thereby protecting the bulb and isolating the socket and electrically charged parts of the night light. Safety caps are also used to deny access to any othe sockets of the outlet servicing the night light, and these safety caps may be designed so that they will perform this function when the protected socket is in use as well as when it is out of service.

9 Claims, 4 Drawing Figures

NIGHT LIGHT

RELATED APPLICATION

This application is a continuation-in-part of application Ser. No. 815,528 filed Jan. 2, 1986.

TECHNICAL FIELD OF THE INVENTION

The present invention relates to night lights and, more particularly, to novel improved night lights which are so designed and constructed as to protect the night light bulb and to preclude access by children and others unable to appreciate the danger of electrical shock to the bulb, the socket in which the bulb is installed, the male connector on the night light base, and the female connectors of the electrical outlet to which the night light is coupled.

BACKGROUND OF THE INVENTION

An astonishing number of children are injured, maimed, and killed each year either by direct contact with a live electrical socket or by inserting a paper clip, knife blade, or other artifact into that socket.

Copending application Ser. No. 815,528 discloses certain novel protective covers that can be employed to control access to such sockets and eliminate the dangers they pose both when the socket is out-of-service and when the male plug at the end of the line cord is plugged into the socket.

SUMMARY OF THE INVENTION

Now, we have developed certain novel night lights which can be used in association with the protective covers disclosed in parent application Ser. No. 815,528 to afford a low level of illumination in circumstances where this is desirable while protecting and precluding access to the night light bulb and precluding access to elements of the installation posing an electrical shock hazard such as the male connector (or prongs) on the night light base, and the exposed female connectors of the electrical outlet into which the night light is plugged.

The protective cover component of our present invention replaces the conventional outlet cover and can be attached to an electrical box by the same type of screw as is employed to attach a conventional cover. Our cover includes a plate resembling the conventional one and, integrated therewith, two externally threaded bosses. These bosses surround openings fashioned in the plate and aligned with the female socket or sockets of the outlet when the cover is attached. Threadable onto these bosses are centrally apertured, internally threaded caps which are designed to either preclude access to an out-of-service socket or to cooperate with the night light component of our invention to protect the night light bulb and to preclude access to those above-identified parts of the electrical outlet and the night light that pose an electrical shock hazard.

The cooperating threads on the caps and bosses are so configured that the cap must be pressed toward the cover plate and simultaneously rotated to engage these threads. This scheme has been employed for a considerable time in closures for containers designed to contain medicines and other toxic substances, and it has been found to be essentially childproof.

As suggested above, the second major component of the present invention is the night light itself. That component includes a base bearing a male connector in the form of electrical prongs, a socket into which a bulb can be threaded, and a flanged protective shield. In use, the night light base is plugged into a female socket of the electrical outlet, the protective shield is placed over the previously installed night light bulb, and the protective cover safety cap is slid over the protective shield and threaded onto that boss of the protective cover surrounding the night light base. This causes the rim surrounding the aperture in the safety cap to trap the flange of the night light protective shield against the boss and thereby secure the protective shield in place.

Typically, the outlet with which the night light is associated will have two female sockets. Access to the second of these can be denied by a second boss and safety cap combination with the safety cap having an imperforate rather than apertured top wall so that the protected socket can not be reached through the safety cap. Alternatively, a cap like that used to fix the night light shield in place can be used, and a disk-like barrier component installed in the cap. The latter is then threaded onto that boss of the cover overlying the socket to be protected, clamping the barrier component against the boss. This also completely isolates the socket from fingers, tongues, and other anatomical members and from tableware, hairpins, and other foreign objects.

To similarly preclude access to this second female socket while it is being used, the protective covers of our present invention can be supplied with dome-shaped and flanged components which are formed of a resilient material and split from end-to- end, providing a gap through which a line cord can be inserted after that cord has been routed through the safety cap. The prongs of the plug attached to the line cord are then inserted into the female socket and the cap tightened onto the boss of the cover associated with the socket. This traps the dome-shaped component against the boss, again totally precluding access to the socket being used.

OBJECTS OF THE INVENTION

From the foregoing, it will be apparent to the reader that one important and primary object of our invention resides in the provision of a novel arrangement for protecting the bulb of a night light against damage and for simultaneously limiting access to the socket of the outlet into which the night light is plugged and to those parts of the night light which pose an electrical shock hazard.

Other also important but more specific objects of our invention reside in the provision of systems as defined in the preceding paragraph:

which are effective;

which are simple and can therefore be furnished at sufficiently low cost to make them economically attractive;

which are so designed that those sockets of the outlet into which the night light is not plugged are also protected against access by those unable to appreciate the dangers involved.

Other important objects and features and additional advantages of our invention will be apparent from the foregoing and the appended claims and as the ensuing detailed description and discussion proceeds in conjunction with the accompanying drawing.

DETAILED DESCRIPTION OF THE INVENTION

Figure 1:
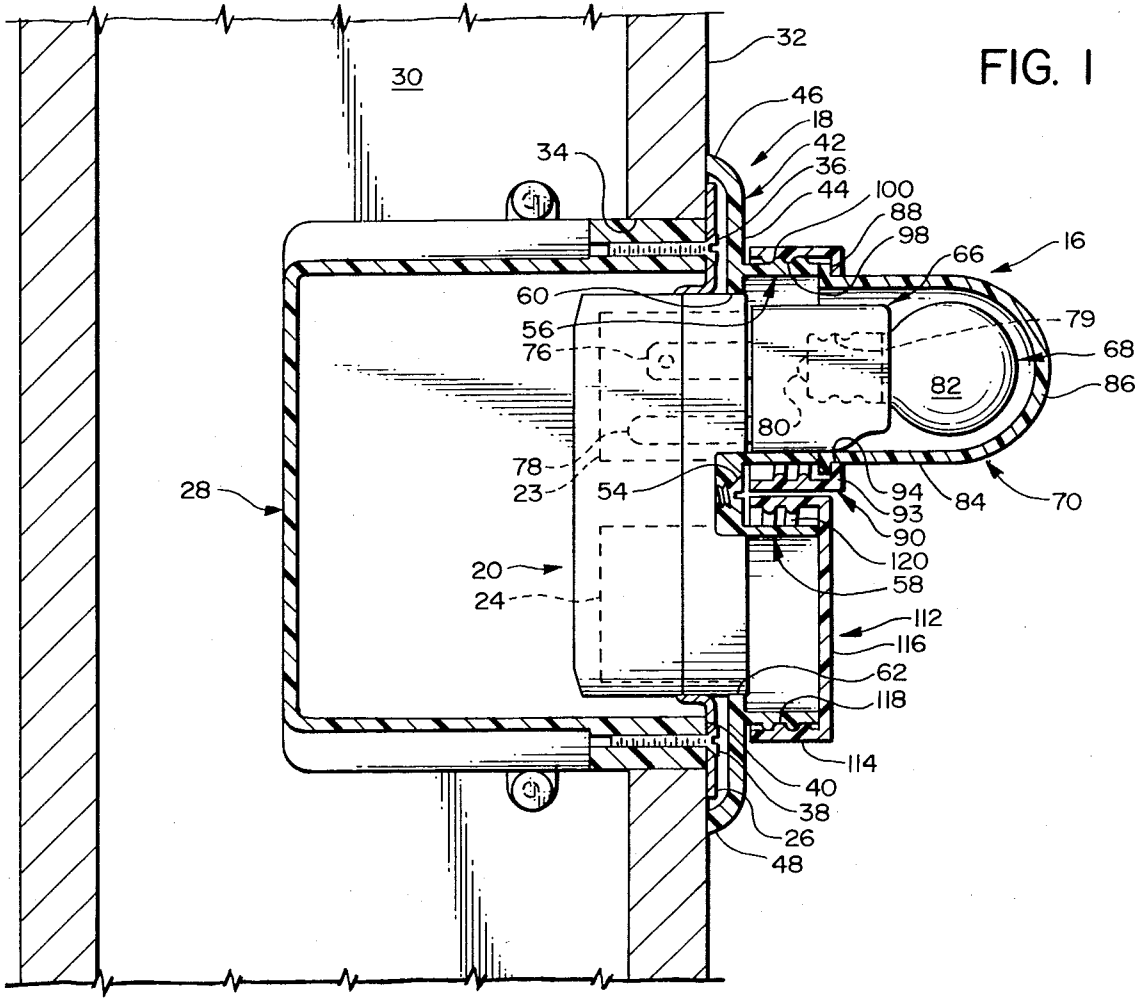
FIG. 1 is a side view of an electrical wall outlet and a night light plugged into that outlet, the night light being so designed and so cooperating with a protective outlet cover as to: (1) protect the night light bulb, and (2) preclude access to the female sockets of the outlet and to those components of the night light which pose a potential shock hazard.
Figure 2:
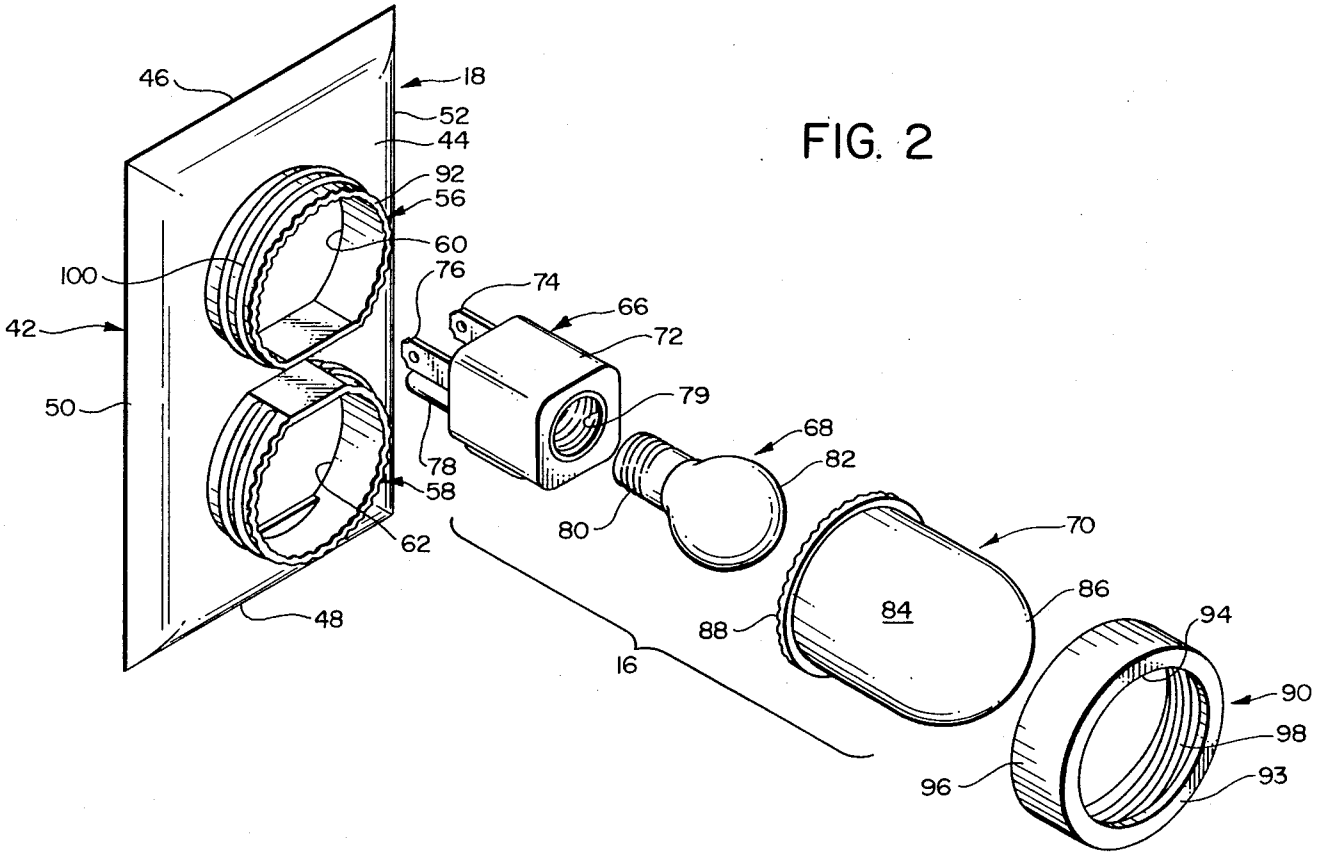
FIG. 2 is an exploded view of the protective cover and the night light.

Referring now to the drawing, FIGS. 1 and 2 depict a night light 16 and a protective cover 18 which cooperate in accord with the principles of the present invention to restrict access to an electrical outlet 20 which supplies the night light with operating current and to those components of the night light which pose a shock hazard.

Outlet 20 is of conventional construction; it includes sockets 23 and 24 supported from a bracket 26. As is required by code, the outlet is housed in an electrical box 28. In the exemplary installation shown in FIG. 1, this box is attached to a vertical stud 30 of a wall which also includes drywall 32 attached to the stud. A cut-out 34 in the drywall accommodates electrical box 28.

Outlet 20 is attached to box 28 by the usual screws 36 and 38 with female sockets or connectors 23 and 24 facing the open side 40 of the box.

Referring now to FIG. 1 and to FIG. 2, protective cover 18 includes a rectangular base plate 42 which has a top wall 44 bounded by angularly included upper, lower, and side walls 46, 48, 50, and 52. To all intents and purposes, plate 42 may be identical to the conventional outlet cover plate except as noted below; and it is attached to bracket 26 of outlet 20 like the latter by the customary screw 54 which extends through an opening (not shown) in base plate 42.

Plate 42 differs from a conventional outlet plate in that it includes integral, externally threaded bosses 56 and 58 which surround openings 60 and 62 through the top wall 44 of the plate. These openings are so located that they are aligned with sockets 23 and 24 when plate 42 is attached to outlet 20 by inserting screw 54 through the aperture in top wall 44 and then threading that screw through the socket supporting bracket 26 of outlet 20.

The night light 16 associated with protective cover 18 includes a conventional base 66, a bulb 68, and a protective shield 70.

Base 66 is of conventional construction. It includes a body member or component 72 from which the usual prongs 74, 76, and 78 extend. These are adapted to mate with the female connectors (not shown) in socket 23 of wall outlet 20. Also, a threaded socket 79 is formed in the body component 72 of night light base 66. This socket is adapted to receive the threaded base 80 of night light bulb 68 which also includes a globe 82 housing a conventional tungsten or other filament (not shown).

In the illustrative embodiment of our invention, the protective shield 70 is employed to protect bulb 68 against breakage or other damage and, in cooperation with protective cover 42, to deny access by those unable to appreciate the danger to those components of the night light and outlet 20 which pose an electrical shock hazard. The protective shield can be fabricated from any impact and breakage resistant material which is sufficiently translucent to transmit energy in the visible part of the electromagnetic spectrum from bulb 68 into the area served by the night light. The protective shield has a cylindrical main body component 84 with a hemispherical dome 86 at one, closed end thereof. A circumferential flange 88 surrounds, and is located at, the opposite open end of the main body component.

Associated with protective cover 18 and night light 16 is a safety cap 90. After bulb 68 has been threaded into base 66, the latter plugged into socket 23, and protective shield 70 installed over bulb 68, safety cap 90 is employed to trap the flange 88 of the protective shield against the exposed or free edge 92 of protective shield boss 56 and thereby secure the protective shield 70 to that boss..

As is best shown in FIG. 2, safety cap 90 has a circumferential rim 93 adapted to engage protective shield 88 and clamp the latter against boss 56. That rim surrounds a central aperture 94 which is of slightly larger diameter than the main body component 84 of the protective shield. Also included in safety cap 90, and extending at right angles to rim 93, is an internally threaded side wall 96.

One of the important features of the present invention is that the internal threads 98 in safety cap 90 and the external threads 100 on boss 56 are so formed that, to engage these threads so that the safety cap may be removed from the boss on which it is threaded, the cap must be firmly pressed toward plate 42 of the protective device and simultaneously rotated in a counterclockwise direction. That is, the safety caps are of the press-and-twist type. As discussed above, past experience has shown that this scheme is essentially childproof which is one of the important goals of the present invention.

FIG. 1 shows night 16 plugged into the socket 23 of outlet 20 with the protective cover 70 or shield of the night light clamped against the boss 56 on protective cover base plate 42 by safety cap 90 (protective dome or shield 70) extends through the central aperture 94 in the safety cap). Also shown in FIG. 1 is a second safety cap 112 which is employed to deny access to the second female socket 24 of outlet 20 when the socket is not in use; i.e., is out of service.

Safety cap 112 is similar to the above-described safety cap 90 to the extent that it has a cylindrical, internally threaded side wall, in this case identified by reference character 114. Instead of a circumferential rim surrounding a central opening, however, safety cap 112 h s an imperforate, flat, top wall 116. With safety cap 112 threaded on protective cover plate boss 58, this totally precludes access to socket 24 as is apparent from FIG. 1.

Like safety cap 90, the cap identified by reference character 112 and employed to protect socket 24 is of the press-and-twist type in that, to engage the internal threads 118 of the cap with the external threads 120 on boss 58 so that the safety cap may be removed from the boss, the cap must first be firmly pressed toward plate 42 of protective device 18 and simultaneously rotated in a counterclockwise direction.

It will often be desirable to protect the second socket 24 of outlet 20 while that socket is being used as well as when it is out of service. To this end, safety cap 112 may be replaced with a second safety cap which duplicates safety cap 90 and is identified by reference charcter 122. A disk-like protective member 123 precludes access through the central opening 124 in the cap when socket 24 is out of service, and a dome-shaped protective shield 126 utilized in conjuction with safety cap 90 precludes access to electrically energized components when socket 24 is being used.

Figure 3:
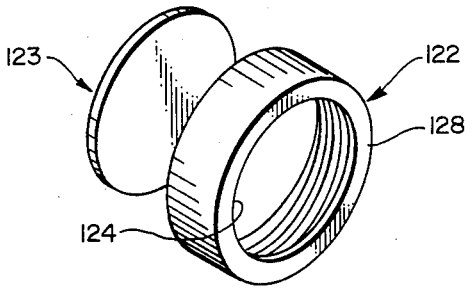
FIG. 3 is an exploded view of an alternate safety cap arrangement which can be employed in the protective cover to deny access to a socket of the outlet which is out of service; i.e., not being used.

As mentioned above, protective disk 123 is designed to be employed when socket 24 is not being used. It is dimensioned to fit within the safety cap 122 with which it is associated and is designed to be trapped against the boss 58 on which the safety cap is threaded by the annular rim 128 of the safety cap as is best shown in FIG. 3. This completely precludes access to the socket 24, essentially eliminating any possibility of an anatomical member or foreign object coming into contact with the socket.

Figure 4:
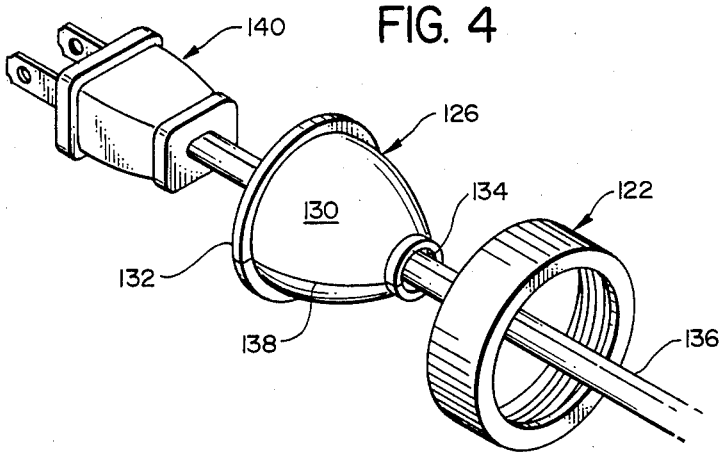
FIG. 4 is an exploded view of a arrangement that can be employed with the protective cover to deny access to a female socket when the male plug at the end of a line cord is plugged into the socket.

Instead of protective disk 123, the dome-shaped shield 126 mentioned briefly above is employed to preclude access to socket 24 when the latter is in use. This shield, which is shown in FIG. 4 and is formed of any suitable resilient material, includes a dome 130 and an integral, annular flange 132. An opening 134 through which a line cord 136 can be routed, and which is dimensioned to closely surround the line cord, is formed in the closed end of dome 130. The opposite, open end of this part is surrounded by the integral, or integrated, annular flange or rim 128.

Protective shield 126 is split from end-to-end, providing the gap 138 shown in FIG. 4. This allows the protective shield to be pried apart so that line cord 136 can be routed through it as shown in the same figure.

To use protective cover 18 to preclude access to electrical socket 24 when the latter is in use, the line cord 136 and the plug 140 attached to the end of that cord are first routed through safety cap 122. Protective shield 126 is then installed over line cord 136 in the manner just described between plug 140 and the safety cap. Next, plug 140 is mated with female socket 24 of outlet 20. Then, protective shield 126 is slid down line cord 136 until flange 132 abuts the protective cover boss 58 overlying the socket 24 being put into service. Finally, safety cap 122 is threaded onto the boss to trap the flange 132 of the protective shield between the boss and the rim 128 of the safety cap. Again, the scheme is one which completely precludes access to the female socket in use.

In the just-concluded detailed description of our invention, several references to orientations such as top, side, upper, lower, etc., were made. This was done for the sake of brevity and to clearly explain the invention and is not intended to impose any restrictions on the scope of our invention as defined in the appended claims.

Also, it will be apparent to the reader that night light 16 could be plugged into the lower socket 24 of outlet 20 instead of upper socket 23 and that socket 23 could then be protected with a safety cap 112 as shown in FIG. 1 or with safety cap 122 and a barrier disk 123 and protective shield 126 as shown in FIGS. 3 and 4. It will also be apparent to the reader that these techniques are equally applicable when the outlet has more than two female sockets as is the case with many wall outlets, which have four sockets.

Also, the invention may be embodied in other specific forms without departing from the spirit or essential characteristics thereof. The present embodiments are therefore to be considered in all respects as illustrative and not restrictive, the scope of the invention being indicated by the appended claims rather than the foregoing description; and all changes which come within the meaning and range of equivalency of the claims are therefore intended to be embraced therein.

We claim:

1. A combination of a night light and a protective cover for limiting access to an electrical outlet which has an exposed female connector that is designed to be mated to the night light, said protective cover including a base plate adapted to fit over and be attached to said outlet, there being an aperture through said base plate which is then aligned with said exposed female connector and an externally threaded boss protruding outwardly from said base plate, said boss terminating in a free edge and surrounding said aperture and said night light comprising a base having a bulb receiving socket formed therein and male connector means adapted to be mated to the female connector of the electrical outlet; a protective shield adapted to surround a bulb received in said socket, said shield having a circumferential flange dimensioned to rest upon the free edge of said boss; and an internally threaded safety cap adapted to be threaded onto said boss to trap the flange of said protective shield against the free edge of said boss and thereby preclude access to: the socket in said base, a bulb threaded into said base, and said male and female connectors.

2. The combination defined in claim 1 wherein the external threads on said boss and the internal threads in said safety cap are so related that pressure must be exerted on said safety cap and said cap simultaneously rotated to engage said external and internal threads in order to allow said cap to be removed from said boss.

3. The combination defined in claim 1 wherein said safety cap has a top wall with a centered opening through which said protective shield is adapted to extend and a rim surrounding said opening, said rim being so dimensioned as to be engageable with the flange on said shield to trap said shield against the free end of the boss on the protective cover.

4. The combination defined in claim 1 wherein said base plate has a second aperture therethrough which is adapted to be aligned with a second exposed female connector of said electrical socket when said base plate is fitted over and attached to said outlet and a second externally threaded boss which protrudes outwardly from said base plate in surrounding relationship to said second aperture and wherein the combination also includes a second, internally threaded safety cap which is threadable onto said second boss to preclude access to said second female connector.

5. The combination defined in claim 4 wherein said second safety cap has a side wall in which said internal threads are formed and an imperforate top wall overlying said side wall.

6. The combination defined in claim 4 wherein the external threads on said boss and the internal threads in said safety cap are so related that pressure must be exerted on said safety cap and said cap simultaneouly rotated to engage said external and internal threads in order to allow said cap to be removed from said boss.

7. The combination defined in claim 4 wherein the second safety cap has a centered opening therein through which a line cord and a male plug attached thereto are adapted to be routed and a circular rim surrounding said opening, said combination also including a barrier component for blocking access to said female connector through said cap when said female connector is not in use, said barrier device being configured to fit within said cap and to be trapped therein and against said boss by the flange of the cap.

8. The combination defined in claim 4 wherein the second safety cap has a centered opening therein through which a line cord and a male plug attached thereto are adapted to be routed and a rim surrounding said aperture, said combination also including a device for precluding access to said female connector through the aperture in said cap when said male plug is mated with said female connector, said device being an open-ended, circularly sectioned dome of resilient, flexible material with an annular flange integrated with said dome at the open end thereof, there being an opening of sufficient size to accommodate only a line cord in that end of the dome opposite said flange, said device being split from end-to-end to form a gap which can be enlarged to allow a line cord to be routed through the device, and said device being so dimensioned that said cap can be slipped over said dome and then threaded on said boss to trap the flange on said device between said boss and the rim on the cap.

9. A night light which has a bulb and which is adapted to cooperate with a protective cover to protect said bulb and to limit access to an electrical outlet which has an exposed female connector and is designed to isolate said night light and to deny access to electrically charged parts of the night light, said night light comprising a base having male connector means extending from one end thereof and a bulb receiving socket formed in and opening onto the opposite end thereof and a protective shield formed of a translucent, impact resistant material, said protective shield having a cylindrical configuration of sufficient diameter and length to surround at least a part of said base and a bulb installed in the socket in said base, that end of the shield adapted to overlie said bulb being closed, the opposite end of said shield being open so that that part of the base bearing the male connector means can extend therethrough, and there being an integral, circular flange surrounding said shield at the open end thereof.

* * * * *